US008356450B2

(12) United States Patent
Larimore

(10) Patent No.: US 8,356,450 B2
(45) Date of Patent: Jan. 22, 2013

(54) SMART PANEL

(76) Inventor: Mark Andrew Larimore, Montgomery, AL (US)

( * ) Notice: Subject to any disclaimer, the term of this patent is extended or adjusted under 35 U.S.C. 154(b) by 168 days.

(21) Appl. No.: 12/692,351

(22) Filed: Jan. 22, 2010

(65) Prior Publication Data

US 2010/0186305 A1 Jul. 29, 2010

Related U.S. Application Data

(60) Provisional application No. 61/146,907, filed on Jan. 23, 2009.

(51) Int. Cl.
*E04B 1/70* (2006.01)

(52) U.S. Cl. ..... 52/302.1; 52/1; 52/302.3

(58) Field of Classification Search ..... 52/1, 302.1, 52/302.3, 403.1, 408, 480
See application file for complete search history.

(56) References Cited

U.S. PATENT DOCUMENTS

| | | | | | |
|---|---|---|---|---|---|
| 2,206,119 | A | | 7/1940 | Persons | |
| 3,045,294 | A | | 7/1962 | Livezey, Jr. | |
| 3,636,725 | A | | 1/1972 | MacCracken | |
| 3,827,202 | A | | 8/1974 | Phillips | |
| 4,290,798 | A | | 9/1981 | Cebalo et al. | |
| 4,507,901 | A | | 4/1985 | Carroll | |
| 4,642,958 | A | | 2/1987 | Pewitt | |
| 4,663,909 | A | | 5/1987 | Ogino et al. | |
| 4,860,506 | A | * | 8/1989 | Yoshimi et al. | 52/144 |
| 4,879,857 | A | | 11/1989 | Peterson et al. | |
| 4,888,927 | A | | 12/1989 | Yoshimi et al. | |
| 4,910,935 | A | * | 3/1990 | Leukel et al. | 52/144 |
| 4,945,697 | A | * | 8/1990 | Ott et al. | 52/403.1 |
| 5,297,992 | A | | 3/1994 | Bailey et al. | |
| 5,299,401 | A | * | 4/1994 | Shelton | 52/393 |
| 5,395,479 | A | | 3/1995 | Petino | |
| 5,412,917 | A | * | 5/1995 | Shelton | 52/403.1 |
| 5,433,050 | A | | 7/1995 | Wilson et al. | |
| 5,467,609 | A | | 11/1995 | Feeney | |
| 5,468,184 | A | | 11/1995 | Collier | |
| 5,487,247 | A | | 1/1996 | Pigg | |
| 5,526,621 | A | * | 6/1996 | Shelton | 52/302.1 |
| 5,561,953 | A | | 10/1996 | Rotter | |
| 5,619,832 | A | * | 4/1997 | Myrvold | 52/403.1 |
| 5,642,967 | A | | 7/1997 | Swain et al. | |
| 5,671,575 | A | * | 9/1997 | Wu | 52/403.1 |
| 5,673,964 | A | | 10/1997 | Roan et al. | |
| 5,685,122 | A | | 11/1997 | Brisbane et al. | |
| 5,694,723 | A | | 12/1997 | Parker | |
| 5,709,767 | A | | 1/1998 | Petino | |
| 5,748,092 | A | | 5/1998 | Arsenault et al. | |
| 5,758,462 | A | | 6/1998 | Finn | |
| 5,966,881 | A | | 10/1999 | Kitagaki | |
| 6,101,768 | A | * | 8/2000 | Springstead et al. | 52/126.6 |
| 6,101,775 | A | | 8/2000 | Larimore | |
| 6,134,854 | A | * | 10/2000 | Stanchfield | 52/480 |
| 6,279,279 | B1 | * | 8/2001 | Larimore | 52/302.1 |
| 6,526,704 | B1 | * | 3/2003 | Berard et al. | 52/177 |
| 6,772,564 | B2 | * | 8/2004 | Leon | 52/126.5 |
| 6,883,287 | B2 | * | 4/2005 | Niese et al. | 52/403.1 |
| 7,121,052 | B2 | * | 10/2006 | Niese et al. | 52/403.1 |
| 7,490,443 | B1 | * | 2/2009 | Lovald et al. | 52/220.2 |
| 7,516,584 | B2 | * | 4/2009 | Valentine | 52/287.1 |
| 7,793,483 | B2 | * | 9/2010 | Stanchfield et al. | 52/716.1 |
| 8,091,314 | B2 | * | 1/2012 | Polk et al. | 52/571 |
| 2003/0051420 | A1 | * | 3/2003 | Leon | 52/126.6 |
| 2003/0110720 | A1 | * | 6/2003 | Berard et al. | 52/263 |

(Continued)

*Primary Examiner* — Mark Wendell
(74) *Attorney, Agent, or Firm* — Remenick PLLC

(57) ABSTRACT

A sub-floor panel and system using the sub-floor panel is disclosed. A sub-floor panel, includes a base, at least one support structure coupled to the base, and at least one ventilation channel adjacent to the support structure.

18 Claims, 2 Drawing Sheets

U.S. PATENT DOCUMENTS

2004/0237452 A1* 12/2004 Niese et al. ..... 52/698
2005/0193670 A1* 9/2005 Niese et al. ..... 52/403.1
2005/0246984 A1* 11/2005 Colosimo et al. ..... 52/263
2006/0070314 A1* 4/2006 Jenkins et al. ..... 52/177
2009/0183455 A1* 7/2009 Polk et al. ..... 52/309.1
2011/0006562 A1* 1/2011 Campbell et al. ..... 296/193.04
2011/0247285 A1* 10/2011 Wybo et al. ..... 52/309.1
2012/0017525 A1* 1/2012 Knapp et al. ..... 52/173.1

* cited by examiner

SMART PANEL

REFERENCE TO RELATED APPLICATIONS

This application claims priority to U.S. provisional application Ser. No. 61/146,907, filed Jan. 23, 2009, entitled "SMART PANEL," which is hereby specifically and entirely incorporated by reference.

BACKGROUND

1. Field of the Invention

The invention is directed to flooring and, in particularly, panels and systems for vented flooring.

2. Background of the Invention

Conventional flooring uses a plurality of layers composed of different types of materials. The materials and the design of the structure support the weight of the floor itself and objects intended to be placed on or supported by the floor. Such flooring is sometimes designed such that a minimal amount of space exists between the various layers and material components to provide increased strength.

A problem with these flooring systems is that they do not provide aeration and are susceptible to undesirable environmental conditions. For example, in a gymnasium or other athletic arena, the flooring system is subjected to high humidity, slab migration and water leaks caused by clogged plumbing, roof leaks, or burst pipes in the walls or flooring, all of which can damage the flooring materials as well as the flooring system. Although a small amount of water may seem fairly innocuous, even small amounts of water and water vapor that persists in the floor can lead to rotting, mold, and the generation of distasteful odors. Larger amounts of water and high humidity cause structural and aesthetic damage to the flooring system as well as the surrounding area. Damage to these areas is difficult or impossible to detect, absent actual removal of the floor itself, and can result in unwanted expansion of the floor components (buckling), excessive contraction producing voids, deterioration, drastic shortening of the life of the component materials, and an often unexpected inability of the flooring to sustain any significant weight, resulting in, at best, structural damage, and personal injury. Structurally damaged areas are nearly always difficult and expensive to replace, often requiring installation of an entirely new flooring system. Additionally, slow migration of water into a flooring system may continue, undetected, until it causes significant damage.

Moreover, damp flooring also attracts insects such as termites and other creatures. These creatures often nest in damp areas of the flooring or subflooring, which becomes a long term habitat attracting and resulting in the proliferation of even more creatures.

U.S. Pat. No. 6,101,775 to Mark Larimore, which is incorporated by reference in its entirety, discloses a system of aerated flooring. It is further desirable to have a flooring panel and system that allows for sub-floor ventilation and moisture monitoring.

SUMMARY OF THE INVENTION

The present invention overcomes the problems and disadvantages associated with current strategies and designs and provides devices and systems for ventilating flooring.

One embodiment of the invention is directed toward a sub-floor panel. The panel is comprised of a base, at least one support structure coupled to the base, and at least one ventilation channel adjacent to the support structure.

In the preferred embodiment, the base and the support structure are a single unit. Preferably, the sub-floor panel is prefabricated. In the preferred embodiment, the support structure is a support strip running at least one of the length of the panel, the width of the panel, and at a 45 degree angle of the panel and the ventilation channels are parallel to the support structures.

The support structure is preferably adapted to be coupled to a finished floor and the base is preferably adapted to be coupled to a sub-floor. The panel preferably has a moisture sensor positioned within the at least one ventilation channel. More preferably, each ventilation channel has at least one moisture sensor. In the preferred embodiment, each ventilation channel is created by removing material from the base.

Another embodiment of the invention is directed toward a second sub-floor panel. The panel includes a body having an upper surface and a lower surface, at least one indentation in the upper surface adapted to allow air flow across at least a portion of the upper surface, and at least one support structure between the upper surface and the lower surface.

In the preferred embodiment, the sub-floor panel is prefabricated. The support structure is preferably a support strip running at least one of the length of the panel, the width of the panel, and at a 45 degree angle of the panel and the indentations are parallel to the support structures. Preferably the support structures are adapted to be coupled to a finished floor and the body is adapted to be coupled to a sub-floor.

The panel preferably also includes at least one moisture sensor positioned within the at least one indentation. More preferably, each indentation has at least one moisture sensor. Preferably the indentations are created by removing material from the body.

Another embodiment of the invention is directed to a flooring system. The system includes a finished floor, a plurality of sub-floor panels coupled to the finished floor, and a sub-floor coupled to the sub-floor panels. Each sub-floor panel comprises a base, at least one support structure coupled to the base, and at least one ventilation channel adjacent to the at least one support structure.

In the preferred embodiment, the system also includes an air circulating device that forces air through the ventilation channels of the sub-floor panels. The air circulating device can be permanent or removable. Preferably there is at least one moisture sensor positioned within the at least one ventilation channel. More preferably, each ventilation channel has at least one moisture sensor.

In the preferred embodiment, the moisture sensors and the air circulating device are in communication. Preferably, the air circulating device is adapted to turn on upon detection of moisture by the moisture sensor and turn off upon detection, by the moisture sensor, of moisture levels below a predetermined threshold level.

The flooring system can also include at least one shock absorbing device positioned between the plurality of sub-floor panels and the sub-floor and at least one riser positioned between the plurality of sub-floor panels and the sub-floor. Preferably, the risers provide additional ventilation channels below the sub-floor panel. In the preferred embodiment, the base and support structures are a single unit. Preferably, the sub-floor panel is prefabricated.

Preferably, at least one support structure is a support strip running at least one of the length of the panel, the width of the panel, and at a 45 degree angle of the panel and preferably the ventilation channels are parallel to the support structures. Preferably, the ventilation channels are created by removing material from the base.

Another embodiment of the invention is directed to a second flooring system. The flooring system includes a finished floor, a plurality of sub-floor panels coupled to the finished floor, and a sub-floor coupled to the lower surface of the sub-floor panels. Each sub-floor panel comprises a body having an upper surface and a lower surface, at least one indentation in the upper surface adapted to allow air flow across at least a portion of the upper surface, and at least one support structure between the upper surface and the lower surface.

In the preferred embodiment, the system also includes an air circulating device that forces air through the indentations of the sub-floor panels. The air circulating device can be permanent or removable. Preferably, the system also includes at least one moisture sensor positioned within the at least one indentation. More preferably, each indentation has at least one moisture sensor. The moisture sensors and the air circulating device are preferably in communication. In the preferred embodiment, the air circulating device is adapted to turn on upon detection of moisture by the moisture sensor and turn off upon detection, by the moisture sensor, of moisture levels below a predetermined threshold level.

The system can include at least one shock absorbing device positioned between the plurality of sub-floor panels and the sub-floor and at least one riser positioned between the plurality of sub-floor panels and the sub-floor. Preferably, the risers provide additional ventilation channels below the sub-floor panel.

In the preferred embodiment, the sub-floor panel is prefabricated. Preferably, the support structure is a support strip running at least one of the length of the panel, the width of the panel, and at a 45 degree angle of the panel and the indentations are parallel to the support structures. Preferably, the indentations are created by removing material from the body.

Other embodiments and advantages of the invention are set forth in part in the description, which follows, and in part, may be obvious from this description, or may be learned from the practice of the invention.

DESCRIPTION OF THE DRAWINGS

The invention is described in greater detail by way of example only and with reference to the attached drawings, in which.

DESCRIPTION OF THE INVENTION

As embodied and broadly described herein, the disclosures herein provide detailed embodiments of the invention. However, the disclosed embodiments are merely exemplary of the invention that may be embodied in various and alternative forms. Therefore, there is no intent that specific structural and functional details should be limiting, but rather the intention is that they provide a basis for the claims and as a representative basis for teaching one skilled in the art to variously employ the present invention.

A problem in the art capable of being solved by the embodiments of the invention is detection and removal of moisture below the finish floor of a flooring system. It has been surprisingly discovered that installing a panel having ventilation channels under the finish floor of a flooring system can assist in removing moisture from the system.

Figure 1:
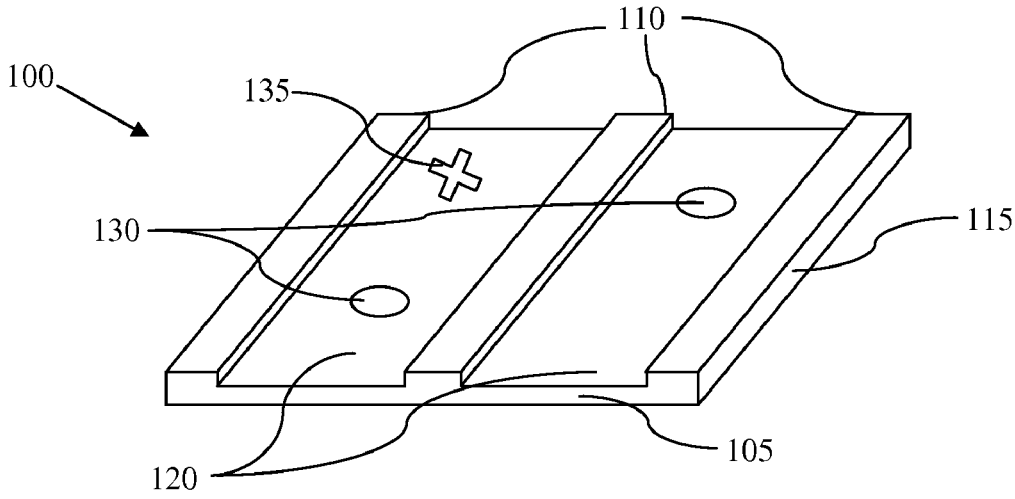
FIG. 1 is an isometric view of an embodiment of a panel of the invention.

FIG. 1 depicts an isometric view of one embodiment of a panel 100 of the invention. Panel 100 may be used in all facets of the building and/or construction industry for example: residential, commercial, sports complexes, industry, etc. Such uses may include: roofing construction, flooring construction, interior or exterior wall construction, roofing deck construction, ceiling construction, or any other type of construction where any amount of ventilation of air and/or moisture would he desirable. Furthermore, panel 100 can be used in applications requiring insulation, for example with sprayed insulation, batts, loose blown insulation, etc. Additionally, panel 100 can be used to facilitate wiring of the structure by providing conduits for the wires to pass through.

Panel 100 is preferably made of plywood; however other materials can be used. For example, panel 100 can be made of other woods, metal, plastic, rubber, and/or other man made or naturally occurring materials. While panel 100 is shown as a square, panel 100 can be another size or shape as dictated by the area into which panel 100 is to be installed. For example, panel 100 can be 24 inches wide by 96 inches long, 48 inches wide by 60 inches long, combinations thereof, or other width and lengths. Preferably, panel 100 is manufactured offsite in easily transportable sizes and shipped to the site where they are to be used. However, panel 100 can be made onsite. In the preferred embodiment, multiple panels 100 are installed in a flooring system. However in some embodiments, only one panel 100 is used.

In the preferred embodiment, panel 100 has a base 105. Base 105 preferably extends over the entirety of panel 100. Base 105 preferably makes up the lower surface of panel 100; however base 105 can be the upper surface of panel 100. Extending from base 105 are supports 110. In an preferred embodiment, supports 110 are strips running the length or width of panel 100, depending on the location into which panel 100 is to be installed. However, in other embodiments, supports 110 can be attachment structures, for example nailing strips. Additionally supports 110 can be at any angle to panel 100. Supports 110 can be of any height above base 105. For example supports 110 can be 0.25 inches tall, 0.5 inches tall or another height. Furthermore, supports 110 can he of any width. For example supports 110 can be 1 inch wide, 2 inches wide, or another width. Furthermore, supports 110 need not be of equal widths. While three supports 110 are shown, one or more supports can be used. While supports 110 are shown as equally spaced, the spacing can differ depending on the conditions of the area into which panels 100 are to be installed.

Supports 110 and base 105 make up the body 115 of panel 100. Body 115 can be of any height, for example body 115 can be 0.5 inches tall, 0.75 inches, tall or one inch tall. In the preferred embodiment, body 115 is one unit. Body 115 can be constructed, for example, by milling out ventilation channels 120 from body 115, molding, or other methods of creating body 115 as one unit. In other embodiments, body 115 can be manufactured by coupling supports 110 to base 105, for example by adhesive, screws, bolts, clips, welding, or other methods.

In the preferred embodiment the body 115 of panel 100 has ventilation channels 120. Preferably, ventilation channels 120 run parallel to supports 110. Ventilation channels 120 are a width through which air can flow, for example 6 inches, 8 inches, or 12 inches. Furthermore, ventilation channels 120 need not be all of equal width or of equal spacing. While two ventilation channels 120 are shown, any number of ventilation channels can be used. Preferably, ventilation channels 120 are uninterrupted through the length or width of panels 100, depending on orientation. Ventilation channels 120 are preferably rectangular in cross-section; however other cross-sectional shapes can be implemented, including but not limited to triangular shapes, trapezoidal shapes, and semicircular shapes.

With panel 100 having one or more channels, the air and/or moisture will be able to move and/or dissipate naturally or via mechanically forced methods, for example by using a blowing device, through the channel or multiple channels as deemed necessary. Thereby, helping to eliminate any moisture from reaching any sub-floor material and/or the finish material or any combination thereof. Thus, helping to reach and/or maintain a desired moisture content in the surrounding air space, finish product material, sub-base material, base material and/or any combination thereof. Thus, greatly reducing the potential of immediate or any future failure of the desired use of a product as it pertains to its functionality, expected useful life, etc. and/or any combination thereof.

In a preferred embodiment, a moisture sensor is coupled to panel 100. Preferably there is one moisture sensor 130 located within each ventilation channel 120. The moisture sensor can be an impedance moisture sensor, a chilled minor moisture sensor, a hydrocarbon dew point moisture sensor or other sensor capable of detecting moisture. The moisture sensor can have an internal source of power (i.e. a battery) or can be connected to the structure's power system (i.e. via an electric plug). In the preferred embodiment, the moisture sensor triggers an alarm upon detection of moisture; however in other embodiments the moisture sensor can trigger a ventilation system 135 upon detection of moisture. The moisture sensor can communicate via wired or wireless communication channels.

Figure 2:
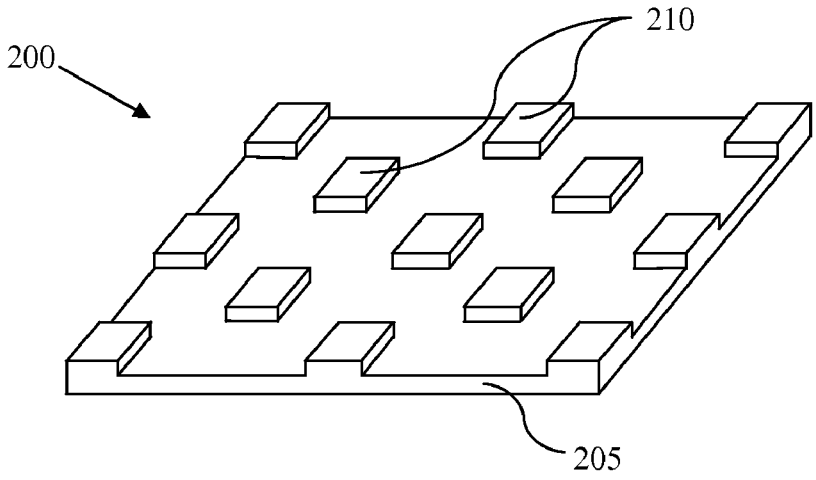
FIG. 2 is an isometric view of another embodiment of a panel of the invention.

FIG. 2 depicts an isometric view of a second embodiment of the panel 200 of the invention. Panel 200 is similar to panel 100 except supports 210 are protrusions from base 205 instead of strips. While supports 210 are show in offset rows, they can be in parallel rows, random arrangements, or other configurations. Furthermore, while supports 210 are shown as rectangular, they can be other shapes, for example circular, triangular, and square. The configuration of the supports of panel 200 allows for ventilation from different angles, thus allowing for the ventilation device to be placed at different locations depending on the area where the panels 200 are installed.

Figure 3:
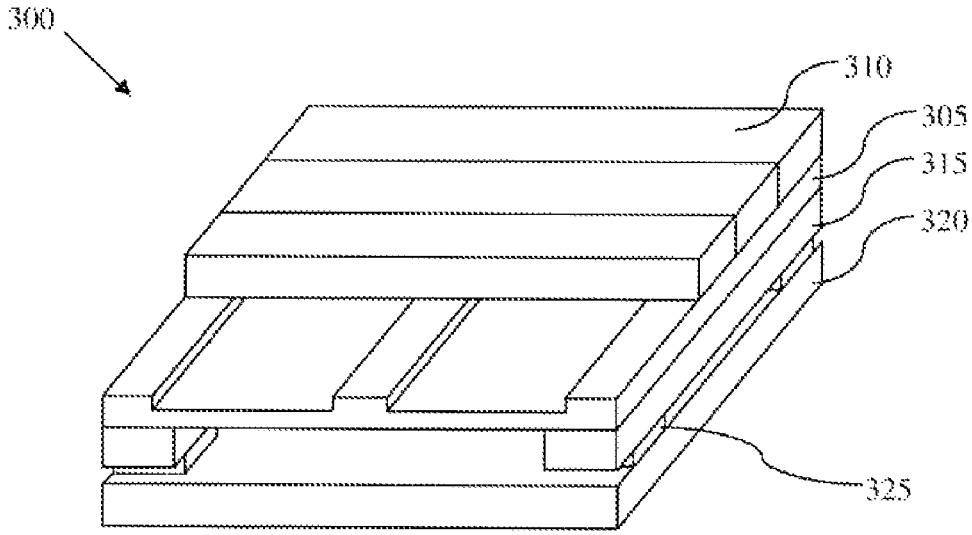
FIG. 3 is an isometric view of an embodiment of the system of the invention.

FIG. 3 depicts an isometric view of a portion of a flooring system 300 using a panel 305 of the invention. Flooring system 300 includes a finished floor 310. Finished floor 310 can be any type of floor, including but not limited to real or imitation wood flooring, plywood flooring, carpeted flooring, metal flooring, marble flooring, tile flooring, and linoleum flooring. While the preferred embodiment is a flooring system, the system can be used in other building surfaces where moisture is undesirable, for example sheet rock, roofing, and/or sub-base material (i.e. sub-flooring, studded walls, and roof decking).

Finished floor 310 is coupled to one or more panels 305. Panel 305 is preferably a panel as described herein. Finished floor 310 can be coupled to panel 305 by one or more methods including, but not limited to loose laid, adhesive, screws, nails, bolts, clips, and rivets. In the preferred embodiment, finished floor 310 is coupled to the supports of panel 305; however, finished floor 310 can be coupled to the base of panel 305. While system 300 is shown with one panel 305 two or more panels 305 can be layered on top of each other.

Coupled to the underside of panel 305 can be at least one riser 315. Risers 315 can be made of any material, can have any size, and can have any shape. Risers 315 are used to adjust the height of finished floor 310 off of sub-floor 320. In the preferred embodiment, risers 315 are strips of wood that provide additional ventilation space below panels 305. Risers 315 are coupled to panel 305 and sub-floor 320 by one or more methods, including, but not limited to, loose laid, adhesive, screws, nails, bolts, clips, and rivets.

In some embodiments, for example athletic floors, flooring system 300 also includes at least one shock absorber 325. Preferably shock absorbers 325 are positioned between panels 305 or risers 315 and sub-floor 320. In the preferred embodiment, shock absorbers 325 are made of rubber; however other materials capable of absorbing shocks can be used. Shock absorbers 325 are coupled to panel 305 or risers 315 and sub-floor 320 by one or more methods, including, but not limited to, loose laid, adhesive, screws, nails, bolts, clips, and rivets.

Flooring system 300 preferably has at least one moisture sensor, as described herein. In the preferred embodiment, each ventilation channel has at least one moisture sensor. The moisture sensor can be affixed to a surface of the ventilation channel, the bottom surface of finished floor 310, or can be embedded into one of the surfaces. Preferably, the moisture sensors are in communication with a ventilation system. The ventilation system can be, for example, a fan or blower, an HVAC system, a heating or cooling unit, a controllable vent, or combinations thereof. Furthermore, the ventilation system can be permanent, removable, and/or repositionable.

In the preferred embodiment, the moisture sensor and the ventilation system work together to detect and rid the flooring system 100 of moisture. For example, upon the moisture sensor detecting moisture, the moisture sensor can alert the ventilation system to activate and, once the moisture sensor detects that the moisture level has dipped below a predetermined threshold level, the moisture sensor can alert the ventilation system to deactivate. For a second example, since moisture may not occur in the vicinity of the moisture detector, the ventilation system can turn itself on periodically and circulate the air within the flooring system 300. The circulated air may pick up moisture and blow across the moisture sensor, thus causing the moisture sensor to detect that there is moisture within the flooring system 300 and indicate that the ventilation system should remain activated.

Other embodiments and uses of the invention will be apparent to those skilled in the art from consideration of the specification and practice of the invention disclosed herein. All references cited herein, including all publications, U.S. and foreign patents and patent applications, are specifically and entirely incorporated by reference. It is intended that the specification and examples be considered exemplary only with the true scope and spirit of the invention indicated by the following claims. Furthermore, the term "comprising of" includes the terms "consisting of" and "consisting essentially of."

The invention claimed is:

1. A sub-floor panel, comprising:

a solid base having a flat first surface;

a plurality of support structures extending perpendicularly from a second surface of the base, the second surface parallel to the first surface;

a plurality of ventilation channels, each ventilation channel disposed between at least two support structures;

at least one moisture sensor positioned within a ventilation channel; and a ventilation system adapted to circulate air within at least one ventilation channel;

wherein the base and the support structures are a single unit and both first surface of the base and the plurality of support structures are adapted to abut a finished floor.

2. The sub-floor panel of claim 1, wherein the sub-floor panel is prefabricated.

3. The sub-floor panel of claim 1, wherein each support structure is a support strip running at least one of the length of the panel, the width of the panel, and at a 45 degree angle of the panel.

4. The sub-floor panel of claim 1, wherein the support structures are couplable to the finished floor and the base is couplable to a sub-floor.

5. The sub-floor panel of claim 1, further comprising at least one moisture sensor positioned within each ventilation channel.

6. The sub-floor panel of claim 5, wherein each ventilation channel has a plurality of moisture sensors.

7. The sub-floor panel of claim 1, wherein the plurality of ventilation channels are disposed between the base and the finished floor.

8. A flooring system, comprising:

a finished floor;

a plurality of sub-floor panels coupled to the finished floor, wherein each sub-floor panel comprises:

a solid base having a flat first surface;

a plurality of support structures extending perpendicularly from a second surface of the base, the second surface parallel to the first surface;

a plurality of ventilation channels, each ventilation channel disposed between at least two support structures;

at least one moisture sensor positioned within a ventilation channel; and an air circulating device adapted to circulate air within the sub-floor panels; and a sub-floor coupled to the sub-floor panels;

wherein the base and the support structures are a single unit and the finished floor overlaps at least one seam between the plurality of sub-floor panels.

9. The flooring system of claim 8, wherein the air circulating device is one of permanent and removable.

10. The flooring system of claim 8, wherein each ventilation channel has at least one moisture sensor.

11. The flooring system of claim 8, wherein the at least one moisture sensor and the air circulating device are in communication.

12. The flooring system of claim 11, wherein the air circulating device is adapted to turn on upon detection of moisture by a moisture sensor and turn off upon detection, by the moisture sensor, of moisture levels below a predetermined threshold level.

13. The flooring system of claim 8, further comprising at least one shock absorbing device positioned between the plurality of sub-floor panels and the sub-floor.

14. The flooring system of claim 8, further comprising at least one riser positioned between the plurality of sub-floor panels and the sub-floor.

15. The flooring system of claim 14, wherein the at least one riser provides additional ventilation channels below the sub-floor panel.

16. The flooring system of claim 8, wherein each sub-floor panel is prefabricated.

17. The flooring system of claim 8, wherein each support structure is a support strip running at least one of the length of the panel, the width of the panel, and at a 45 degree angle of the panel.

18. The flooring system of claim 8, wherein each ventilation channel is disposed between the finished floor and the base.

* * * * *